US009192538B2

(12) United States Patent
Bacchiocchi

(10) Patent No.: US 9,192,538 B2
(45) Date of Patent: Nov. 24, 2015

(54) ADAPTER MATTRESS FOR DENTAL CHAIRS

(76) Inventor: Danilo Bacchiocchi, Castelfidardo (IT)

( * ) Notice: Subject to any disclaimer, the term of this patent is extended or adjusted under 35 U.S.C. 154(b) by 11 days.

(21) Appl. No.: 14/343,556

(22) PCT Filed: Sep. 13, 2011

(86) PCT No.: PCT/IT2011/000314

§ 371 (c)(1),
(2), (4) Date: Mar. 7, 2014

(87) PCT Pub. No.: WO2013/038431

PCT Pub. Date: Mar. 21, 2013

(65) Prior Publication Data

US 2014/0215723 A1 Aug. 7, 2014

(51) Int. Cl.

| | |
|---|---|
| ***A61G 15/12*** | (2006.01) |
| ***A47C 31/11*** | (2006.01) |
| ***A61G 13/12*** | (2006.01) |
| ***A47C 20/02*** | (2006.01) |
| ***A47C 7/02*** | (2006.01) |
| ***A61G 15/00*** | (2006.01) |
| ***A61G 15/10*** | (2006.01) |

(52) U.S. Cl.

CPC ..... *A61G 15/12* (2013.01); *A47C 7/021* (2013.01); *A47C 20/028* (2013.01); *A47C 31/11* (2013.01); *A61G 13/129* (2013.01); *A61G 13/1285* (2013.01); *A61G 15/00* (2013.01); *A61G 15/10* (2013.01)

(58) Field of Classification Search

CPC .... A47C 31/105; A47C 31/11; A47C 20/026; A47C 20/027; A47C 20/028; A47C 27/00; A47C 27/001; A47C 7/021; A47C 7/022; A61G 13/12; A61G 13/126; A61G 13/128; A61G 13/1285; A61G 13/129; A61G 13/1295; A61G 15/00; A61G 15/002; A61G 15/10; A61G 15/12; A61G 15/125; A61G 7/057

USPC ..... 297/229, 230.1, 230.13, 284.1, 284.4, 297/284.5

See application file for complete search history.

(56) References Cited

U.S. PATENT DOCUMENTS

| | | | | | |
|---|---|---|---|---|---|
| 1,419,006 | A | * | 6/1922 | Barrett | 297/230.1 |
| 3,156,500 | A | * | 11/1964 | Kerr | 297/391 |
| 3,747,916 | A | * | 7/1973 | Benson | 5/600 |
| 3,753,592 | A | * | 8/1973 | Jensen | 297/284.1 |
| 4,047,758 | A | * | 9/1977 | Whitehill | 297/284.1 |
| 4,207,635 | A | * | 6/1980 | Leroy | 5/656 |

(Continued)

FOREIGN PATENT DOCUMENTS

| | | | |
|---|---|---|---|
| DE | 499358 | C | 6/1930 |
| DE | 4441804 | C1 | 3/1996 |
| DE | 10035681 | A1 | 2/2002 |

OTHER PUBLICATIONS

International Search Report for corresponding International Application No. PCT/IT2011/000314.

*Primary Examiner* — David E Sosnowski
*Assistant Examiner* — David R Hare
(74) *Attorney, Agent, or Firm* — Egbert Law Offices, PLLC

(57) ABSTRACT

An adapter mattress for a dental chair is disclosed, comprising a flat upper surface and a lower surface with a suitably curved profile to adapt to the curvature of a dental chair, so that the upper surface of the mattress is disposed according to a horizontal plane, converting the dental chair into a surgery couch.

6 Claims, 2 Drawing Sheets

(56) References Cited

U.S. PATENT DOCUMENTS

| | | | | | |
|---|---|---|---|---|---|
| 4,413,858 | A * | 11/1983 | Beach | 297/217.1 |
| 4,829,615 | A * | 5/1989 | Raymond | 5/731 |
| 5,331,698 | A * | 7/1994 | Newkirk et al. | 5/602 |
| 5,474,513 | A * | 12/1995 | Carlesimo et al. | 482/140 |
| 5,795,276 | A * | 8/1998 | Almeda | 482/142 |
| 5,893,183 | A * | 4/1999 | Bechtold, Jr. | 5/632 |
| 6,067,678 | A * | 5/2000 | Trevino | 5/628 |
| 6,357,066 | B1 * | 3/2002 | Pierce | 5/710 |
| 6,899,662 | B2 * | 5/2005 | Gamble et al. | 482/142 |
| 6,969,114 | B2 * | 11/2005 | Keilhauer | 297/230.1 |
| 7,150,057 | B1 * | 12/2006 | Santiago et al. | 5/648 |
| 7,665,165 | B2 * | 2/2010 | Maganov | 5/419 |
| 2007/0163049 | A1 * | 7/2007 | Brinkerhoff et al. | 5/637 |
| 2009/0188047 | A1 * | 7/2009 | Morse | 5/655.9 |
| 2010/0281617 | A1 * | 11/2010 | Brun | 5/632 |
| 2012/0304387 | A1 * | 12/2012 | Crompton et al. | 5/632 |
| 2013/0245395 | A1 * | 9/2013 | Bidarian Moniri | 600/301 |

* cited by examiner

ADAPTER MATTRESS FOR DENTAL CHAIRS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present patent application for industrial invention relates to an adapter mattress for dental chairs.

2. Description of Related Art Including Information Disclosed Under 37 CFR 1.97 and 37 CFR 1.98

Dentist's surgeries make large use of dental chairs connected to a dental drill unit that controls operation of dental chair.

FIG. 4 shows a dental chair (100) connected to a dental drill unit (200).

Dental chair (100) comprises:

first portion (101) where legs rest, called leg rest;

second portion (102) where buttocks rest, called seat; and third portion (103) where back rests, called back rest.

Leg rest (101) is coupled with seat (102) and joined by means of curved connection portion (104). Leg rest (101) is disposed according to a plane that is substantially hotizontally or slightly inclined downwards. Seat (102) is inclined downwards with respect to leg rest (101). So between leg rest (101) and seat (102) an obtuse angle ($\alpha$) of approximately 140°-160° is defined.

Back rest (101) is articulated with respect to seat (102). Back rest (103) can be inclined upwards with respect to seat (102) by an angle ($\beta$) from 180° to 90° according to the operator's needs. So, between seat (102) and back rest (103) a curved recessed portion (105) is defined. Generally, during surgical sessions, the angle ($\beta$) is regulated substantially equal to angle ($\alpha$). Therefore, the upper part of dental chair (100) comprises a concave recessed part (105) separating seat (102) from back rest (103) and convex upward-protruding part. (104) connecting leg rest (101) to seat (102).

The dental drill unit (200) controls the height of seat (102), inclination of back rest (103) and comprises various functions, such as delivery of water, compressed air and electricity to power scyalitic lamps and other dental tools.

In any case, upper surface of leg rest (101), seat (102) and back rest (103) is ergonomic and suitably curved and shaped to follow the configuration of the patient's body.

Such a type of dental chair is impaired by some drawbacks, being not versatile and not suitable to patient's treatments other than dental ones.

Following to dental treatment, patients often need surgical, dermatological, osteopathic, massotherapy and similar treatments. Evidently, such treatments cannot be carried out on a dental chair. Consequently, patients are obliged to abandon the dentist's surgery and more to another room provided with surgical couch provided with perfectly horizontal patient's support surface.

BRIEF SUMMARY OF THE INVENTION

The purpose of the present invention is to eliminate the drawbacks of the prior art, by disclosing an adapter mattress for dental chairs that is practical, versatile, easy to use inexpensive and simple to make.

These purposes have been achieved according, to the invention, with characteristics claimed in independent claim 1.

Advantageous embodiments appear from the dependent claims.

The adapter mattress for dental chairs of the invention comprises flat upper surface and lower upper surface with suitably curved profile in order to adapt to curvature of dental chair, so that upper surface of mattress is disposed according to a horizontal plane, converting the dental chair into a surgery couch.

The advantages of the invention are clear, it being able to convert, a dental chair into a surgical couch rapidly, simply and safely.

BRIEF DESCRIPTION OF THE DRAWINGS

Further characteristics of the invention will appear more evident from the detailed description below, which refers to a merely illustrative, not limiting, embodiment, as shown in the attached drawings, wherein.

DETAILED DESCRIPTION OF THE INVENTION

Figure 1:
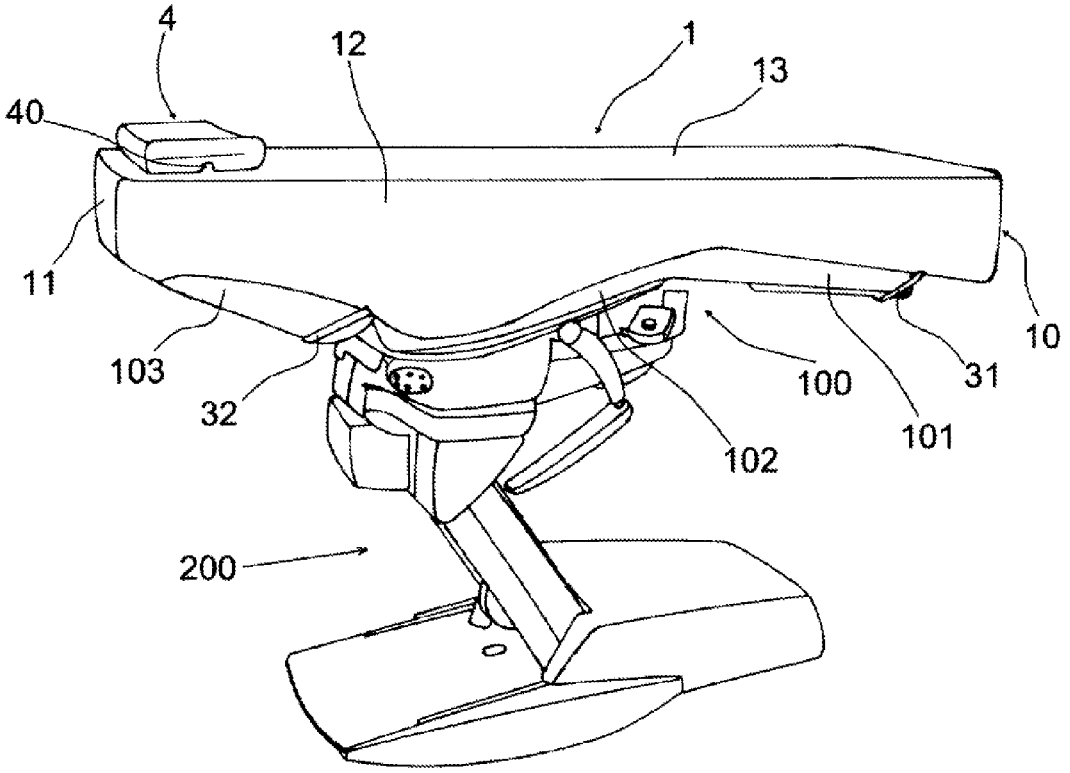
FIG. 1 is a perspective view of the adapter mattress of the invention disposed on a dental chair.
Figure 2:
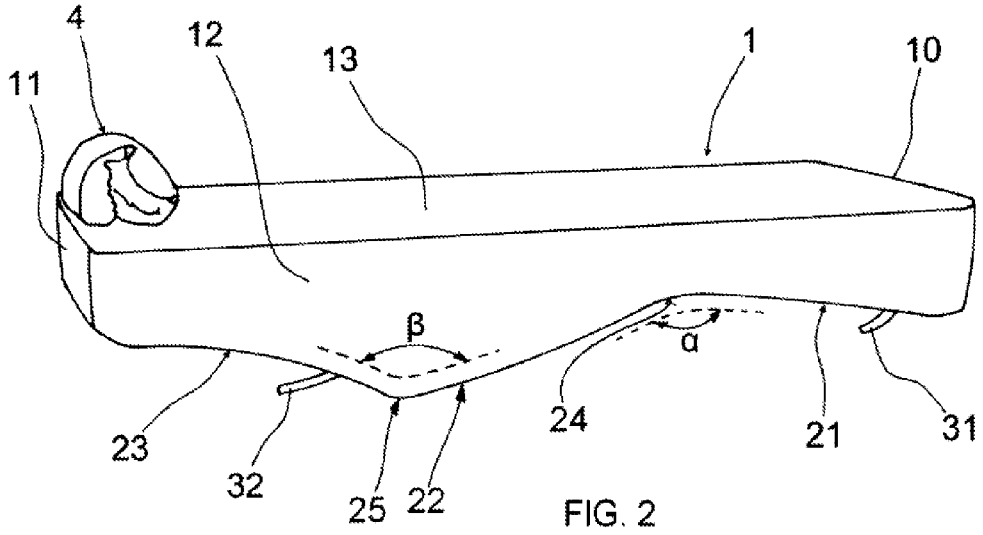
FIG. 2 is a perspective top view of the adapter mattress of FIG. 1.
Figure 3:
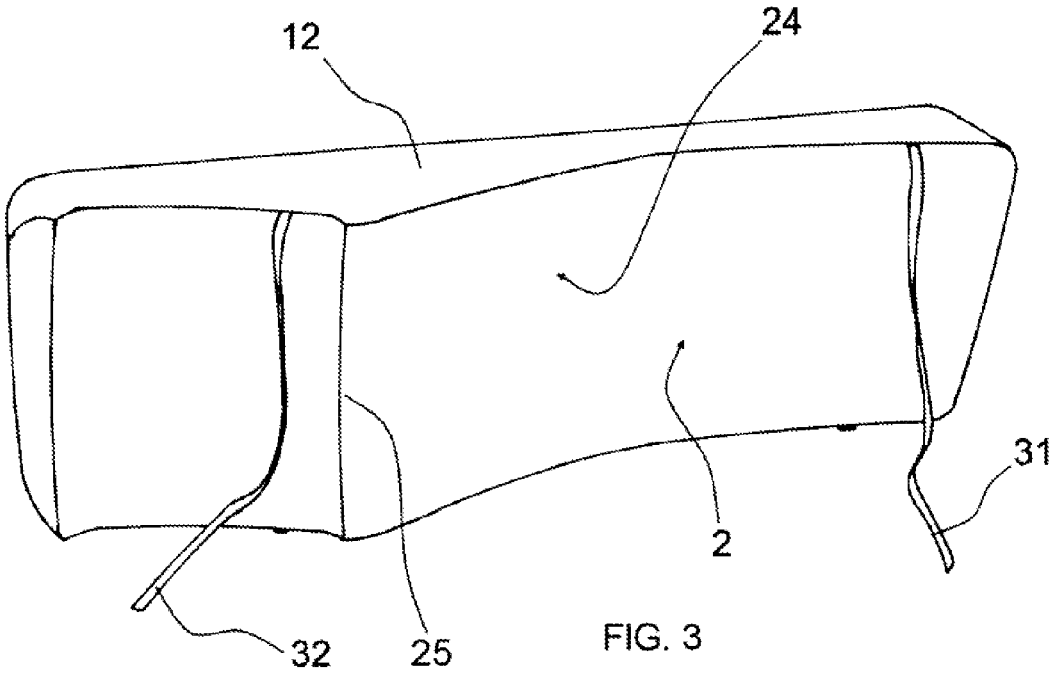
FIG. 3 is a perspective view of the adapter mattress of FIG. 2, disposed on one side.
Figure 4:
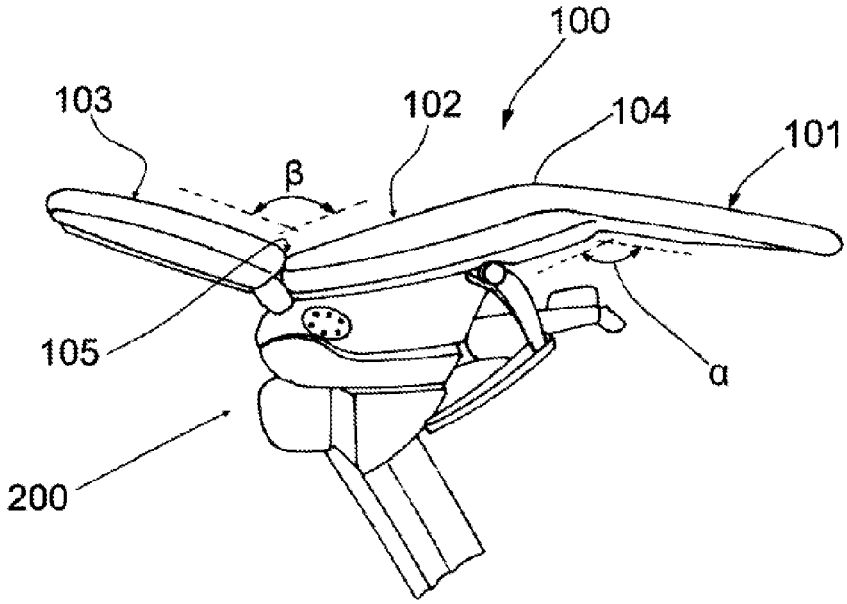
FIG. 4 PRIOR ART
FIG. 4 is a perspective view of a dental chair according to prior art.

Referring to FIGS. 1 to 3, the adapter mattress of the invention is disclosed, being generally indicated with numeral (1).

Hereafter parts of dental chair (100) that have been already described are indicated with same numerals, omitting a detailed description.

The adapter mattress (1) has a basically parallelepiped shape and comprises first transversal border (10) in correspondence of feet, second transversal border (11) in correspondence of head and two lateral borders (12).

Mattress (1) comprises upper flat surface (13) and lower surface (2) (FIG. 3) with suitably curved profile to adapt to curvature of dental chair (100), so that upper surface of mattress is disposed according to a horizontal plane, converting dental chair (100) into a surgery couch.

Upper surface (13) has rectangular dimensions typical of surgery couch, for example 2 m×0.5 m.

In particular, lower surface (2) of mattress comprises convex portion (25), shaped as downward-protruding bump, which is disposed in said recessed concave portion (105) between seat (102) and back rest (103) of dental chair (FIG. 1).

Moreover, lower surface (2) of mattress provides for concave portion (105) disposed above curved portion (104) connecting seat (102) and leg rest (101) of dental chair.

Therefore, lower surface (2) of mattress comprises:

first portion (21) extending from first transversal edge (10) to concave portion (24);

second portion (22) extending from concave portion (24) to convex portion (25); and third portion (23) extending from convex portion (25) to second transversal edge (11).

The first portion (21) of lower surface of mattress is parallel or slightly inclined with respect to upper surface (13) of mattress with slightly increasing thickness from concave portion (24) to first transversal edge (10).

Second portion (22) of lower surface of mattress is inclined with respect to first portion (21) by obtuse angle ($\alpha$) of approximately 140°-160°.

Third portion (23) of lower surface of mattress is inclined with respect to second portion (22) by obtuse angle ($\beta$) of approximately 140°-160°. Preferably angle ($\alpha$) is identical to angle ($\beta$).

Transversal edges (10, 11) of mattress are basically flat with thickness of approximately 15-30 cm, so that mattress can be positioned vertically on ground with minimum overall dimensions.

Belts (31 , 32) are connected to mattress (1) in order to be firmly fixed to dental chair (100). Belts (31, 32) are provided with suitable buckles for closing and tensioning. A first belt (31) is disposed in correspondence of first portion (21) of lower surface of mattress to tie round foot rest (101) of dental chair. A second belt (32) is disposed in correspondence of third portion (23) of lower surface of mattress to tie round back rest (103) of dental chair, in proximity of part connecting with seat (102).

For illustrative, not limiting purposes, mattress (1) comprises padding and external coating. Padding can be obtained from molding foamed material, such as polyurethane foam. External coating can be, for instance, poly latex, leather or imitation leather.

Mattress (1) is provided with cushion (4) with low thickness, in such way to be folded and rolled up, as shown in FIG. 2. Cushion is provided with Velcro (40) to be maintained in rolled-up configuration. Cushion (4) can be made from same material as mattress.

Numerous variations and modifications can be made to the present embodiment of the invention, within the each of experts of the field, while still falling within the scope of the invention as claimed in the attached claims.

The invention claimed is:

1. An apparatus comprising:

a dental chair having a seat and a back and a concave portion recessed between said seat and said back, said back extending angularly downwardly toward said concave portion, said seat extending angularly upwardly from said concave portion, said dental chair having a leg rest extending from a curved convex portion, said curved convex portion connecting said seat and said leg rest; and an adapter mattress positioned on said dental chair, said adapter mattress having a flat upper surface and a lower surface, said lower surface having a first portion and a second portion and a third portion, said lower surface having a convex portion between said second portion and said third portion that is received in said concave portion of said dental chair, said third portion overlying said back of said dental chair and having a thickness that decreases from said convex portion to one end of said adapter mattress, said adapter mattress having a concave portion formed between said second portion and said first portion, said convex portion of said dental chair received in said concave portion of said adapter mattress, said second portion overlying said seat of said dental chair and having a decreasing thickness from said convex portion of said adapter mattress to said concave portion of said adapter mattress, said first portion of said adapter mattress overlying said leg rest of said dental chair.

2. The apparatus of claim 1, said first portion of said lower surface of said adapter mattress being in generally parallel relation to said top surface of said adapter mattress.

3. The apparatus of claim 1, said second portion of said lower surface of said adapter mattress extending at an angle of between 140° and 160° with respect to said first portion of said lower surface of said adapter mattress.

4. The apparatus of claim 1, said third portion of said lower surface of said adapter mattress extending at an angle of between 140° and 160° with respect to said second portion of said lower surface of said adapter mattress.

5. The apparatus of claim 1, said one end of said adapter mattress being substantially flat and having a thickness of between 15 and 30 centimeters, said adapter mattress having an opposite end that is substantially flat and has a thickness of between 15 and 30 centimeters.

6. The apparatus of claim 1, said adapter mattress having at least one belt affixed thereto, the belt securing said adapter mattress onto said dental chair.

* * * * *